US005374296A

United States Patent [19]

Jones

[11] Patent Number: 5,374,296

[45] Date of Patent: Dec. 20, 1994

[54] LANCE CARRIAGE

[75] Inventor: Gary D. Jones, Mount Isa, Australia

[73] Assignee: Mount Isa Mines Limited, Australia

[21] Appl. No.: 90,121

[22] PCT Filed: Jan. 17, 1992

[86] PCT No.: PCT/AU92/00017

§ 371 Date: Sep. 22, 1993

§ 102(e) Date: Sep. 22, 1993

[87] PCT Pub. No.: WO92/13246

PCT Pub. Date: Aug. 6, 1992

[30] Foreign Application Priority Data

Jan. 24, 1991 [AU] Australia ..... PK 4325

[51] Int. Cl.[5] ..... C21C 5/46

[52] U.S. Cl. ..... 75/414; 75/528; 266/44; 266/226

[58] Field of Search ..... 266/226, 44; 75/414, 75/528

[56] References Cited

U.S. PATENT DOCUMENTS

| | | | |
|---|---|---|---|
| 4,097,031 | 6/1978 | Higuchi et al. | 266/226 |
| 4,139,185 | 2/1979 | Henryson . | |
| 5,167,904 | 12/1992 | Stomp et al. | 266/226 |

FOREIGN PATENT DOCUMENTS

| | | | |
|---|---|---|---|
| 282970 | 10/1965 | Australia . | |
| 464427 | 1/1992 | European Pat. Off. | 266/226 |
| 1458837 | 1/1969 | Germany . | |
| 53-114709 | 10/1978 | Japan . | |
| 921645 | 3/1963 | United Kingdom . | |
| 1111318 | 4/1968 | United Kingdom . | |
| 831803 | 5/1981 | U.S.S.R. . | |

*Primary Examiner*—Melvyn J. Andrews

*Attorney, Agent, or Firm*—Stevens, Davis, Miller & Mosher

[57] ABSTRACT

An elongate lance (4) is raised or lowered by means of a carnage (7) which is guided by vertical channels (8). The lance has lateral projections (18) whereby it is supported in a cradle (17) mounted to carriage (7) via springs (29). The apparatus permits the lance lower end (12) to be submerged in bath (3) and permits restricted lateral movement of the lance lower end.

10 Claims, 8 Drawing Sheets

LANCE CARRIAGE

TECHNICAL FIELD

The present invention relates to furnaces and in particular to apparatus to inject material into a furnace bath.

BACKGROUND OF THE INVENTION

It is conventional to inject materials such as air into furnace baths via openings (or tuyers) located towards the bottom of the furnace. It is also known in steel making to direct oxygen into a furnace via axially mounted downwardly extending lances suspended above the bath. More recently it has been proposed to use a pyrometallurgical lance which can be lowered into the furnace bath from above. In such proposals the lances inject air or oxygen enriched air through an outer tube and in some processes, a fuel such as oil or coal through a concentric inner tube. Swirlers are located the lance to improve cooling of the outer wall. As the the lower end or tip of the lance is lowered into the furnace, slag resting on the top of the bath may splash on to the lance and freeze and adds further protection as the lance contacts with the bath.

Relatively small pilot plants having a capacity of 50 kg to 5000 kg have been described in which a lance of approximately 2–12 cm cross section is raised and lowered by a wire and pulley and stabilized by guy wires. However, such means would not be practical for a large scale plant with a lance of for example 30–45 cm diameter and being 10 meters long. When the lance tip is submerged the bath becomes intensely agitated. These lances require to be periodically repaired due to consumption of the lance tip. Problems have been encountered in trials involving maneuvering of such lances into and out of position as well as in raising and lowering the lance into the furnace. Because of the size and weight of the lance and space constraints typical of a furnace site, maneuvering a lance into and out of its mounting is intrinsically difficult and potentially hazardous. Replacement of one lance by another must be accomplished without delay. Moreover it has been discovered that if a 10 meter long lance is rigidly mounted as hitherto practiced with non submerged lances, stresses are introduced due to the intense agitation of the melt at the lower end of the lance and the lance fractures or the carriage and guides is damaged.

It has also been found that if too great a latitude of movement of the lance tip is permitted, the lance deflects the circulating bath flow causing increased wear on the lance itself, and introducing undesirable mixing of the bath. Furthermore, in situations of continuous feed and/or continuous or batch tapping it is necessary to control the height of the lance tip to ensure adequate oxygen transfer and temperature control of the bath.

It is an object of the present invention to provide improved means for raising and lowering a lance into a furnace.

SUMMARY OF THE INVENTION

According to one broad form the invention consists of an apparatus for injecting material into a furnace bath comprising an elongate lance having a lance lower end, a carriage including lance mounting means for releasably supporting the lance, means for guiding the carriage upwardly and downwardly whereby to move the lance lower end between a position above the bath and a position submerged in the bath, and means to permit restricted lateral movement of the lance lower end relative to the furnace bath.

Preferably the carriage runs on guide columns above the furnace bath.

In a preferred embodiment the lance has laterally projecting shafts which are supported in a cradle on the carriage and the cradle is resiliently mounted to the carriage to allow a degree of lateral movement of the lance with respect to the carriage and furnace bath.

The submerged tip of a lance mounted according to the invention is able to move laterally through an arc of up to, but not greater than 10° (i.e. 5° from vertical), and more preferably through an arc of at least 2.5° but not greater than 5° (i.e. not greater than 2.5° from vertical).

BRIEF DESCRIPTION OF DRAWINGS

A preferred embodiment of the invention will now be described, by way of example only, with reference to the accompanying drawings in which.

DETAILED DESCRIPTION OF PREFERRED EMBODIMENTS OF THE INVENTION

Figure 1A:
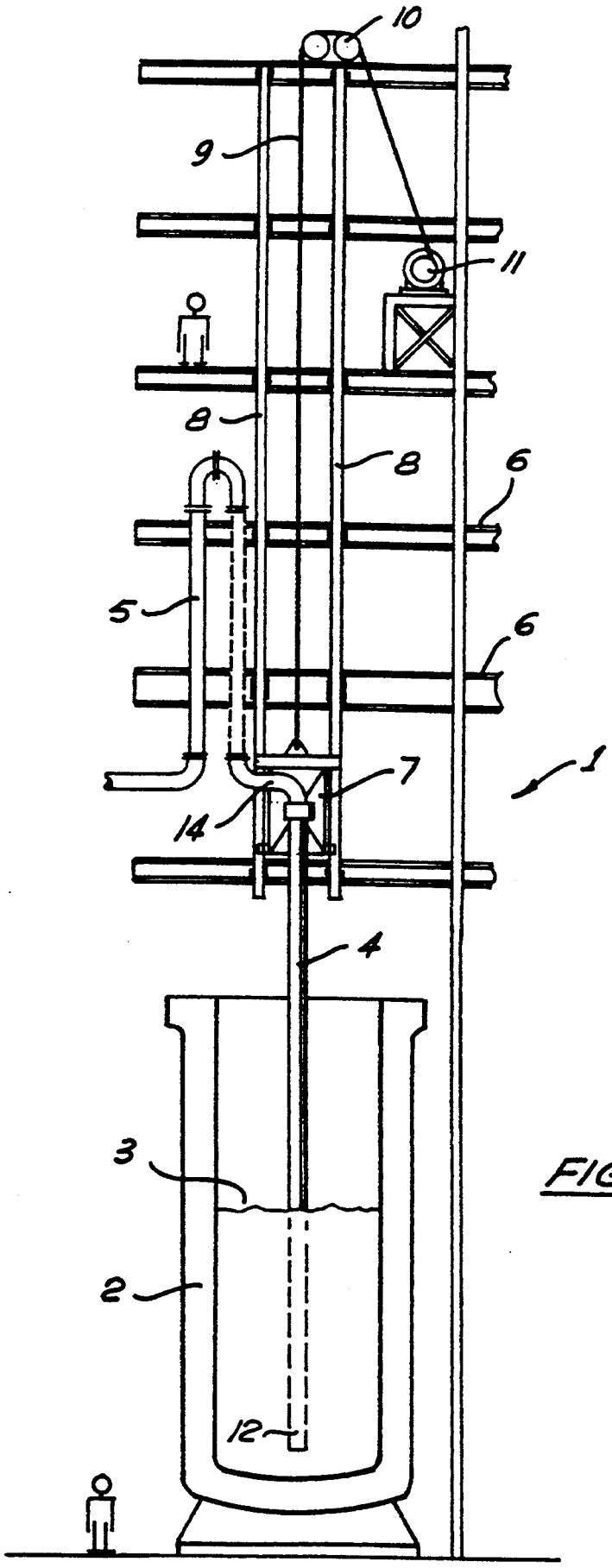
FIG. 1A is a schematic representation of a furnace arrangement showing a lance in a lowered position.
Figure 1B:
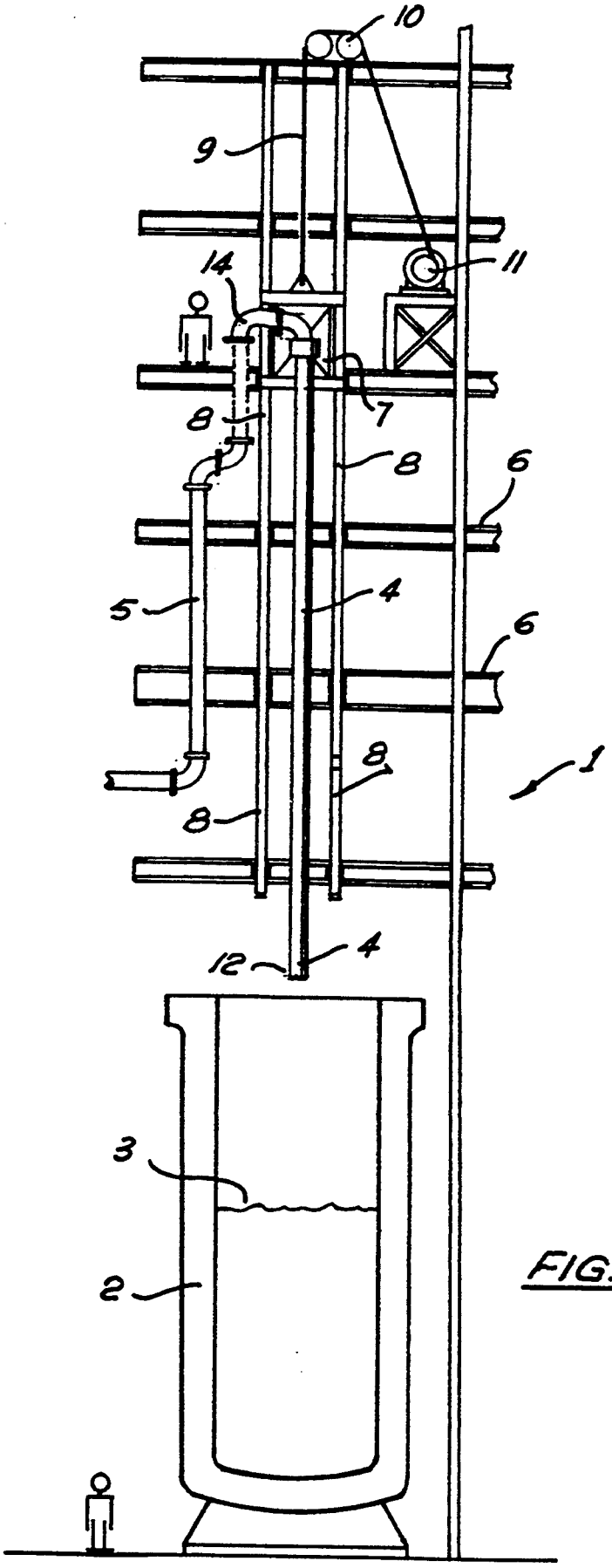
FIG. 1B corresponds to FIG. 1A but shows the lance in a raised position.
Figure 3:
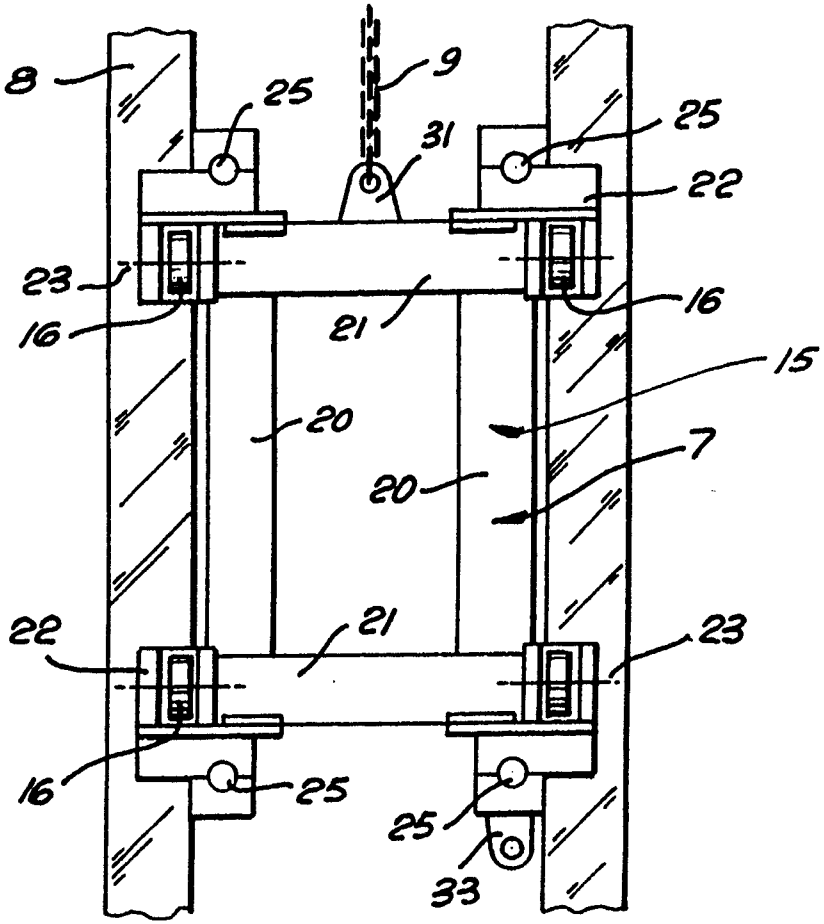
FIG. 3 is a schematic representation in elevation of a carriage according to the present invention.

Referring to the drawings a furnace arrangement is shown schematically in FIGS. 1A and 1B. Furnace 2 is an upright generally cylindrical furnace containing a bath having a bath surface 3.

Typically, a furnace bath contains a layer of slag. A layer of liquid metal or matte may underlie the slag.

The furnace arrangement of FIG. 1A includes a lance 4 which in FIG. 1A is shown in a lowered position with the lance tip submerged below bath surface and in FIG. 1B is shown in a raised position. Lance 4 is connected via a flexible coupling 14 through a series of pipework 5 to a source of material, in this case air, which is to be injected into the furnace bath. The arrangement is seen to include a framework 6 several stories high (with reference to a man's silhouette) provided with platforms for access to machinery. Lance 4 is typically about 10 meters long. The top of lance 4 is releasably mounted on a carriage 7 which will be described in detail hereinafter, for reciprocal movement in a vertical direction to the furnace 2. Carriage 7 runs on guide channels 8 mounted to framework 6 and is raised and lowered on a chain 9 connected to the top and bottom of carriage 7 as also discussed below. Chain 9 is driven by runs over pulleys 10 at the top of the installation and is driven by a motor 11. The chain returns via pulley 10 at the bottom of the illustration and is fastened to the bottom of the carriage to ensure positive drive in both raise and lower directions. Overhead cranes (not illustrated) are used to lift lance 4 off carriage 7 for lance replacement. During this operation the carriage is in the raised position.

Figure 2:
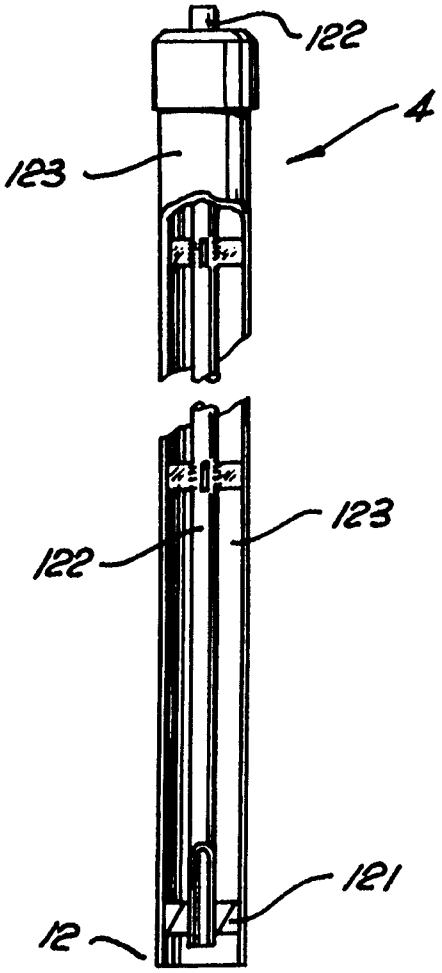
FIG. 2 is a section view of a lance used with the present invention.
Figure 4:
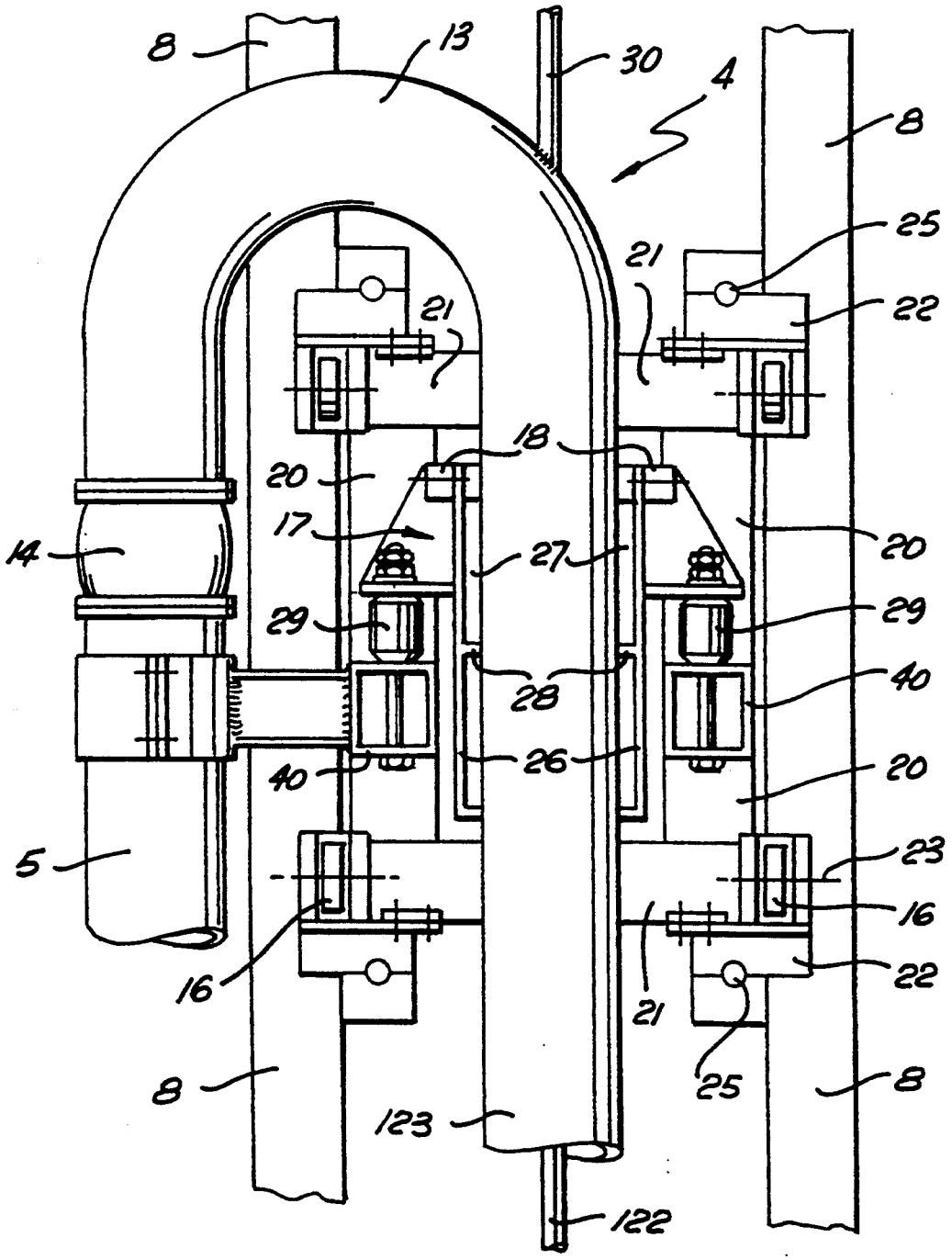
FIG. 4 is a detailed elevation view of the carriage according to the invention with the lance mounted thereto.
Figure 5:
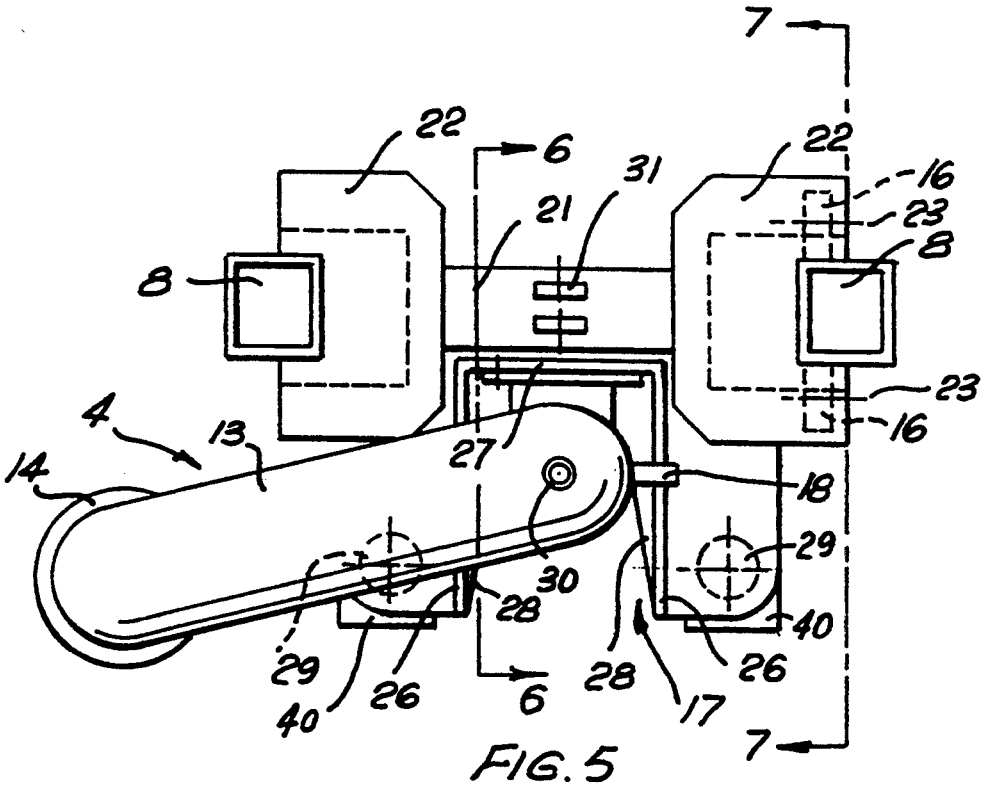
FIG. 5 is a plan view of the carriage and lance of FIG. 4.

The lower end 12 (or "lance tip") of lance 4 is shown in FIG. 2 and includes a swirler 121 adjacent the tip to assist in the distribution of material into the furnace bath. Lance 4 includes an inner tube 122 surrounded by an outer tube 123 which define an outlet at the lance lower end. In the present example, air is injected into the furnace bath through outer tube 123 and oil through inner tube 122. The lance may optionally have a gooseneck at its upper end as shown in FIGS. 4 and 5 or may be straight.

In use tip 12 of lance 4 is lowered to be immersed in the molten furnace bath at which time air or air and fuel in a predetermined ratio is injected into the bath. Care needs to be taken to ensure that lance tip 12 does not become immersed in the matte layer as permanent damage would then be effected within a short time after immersion. If correctly positioned within the bath, lance 4 can be used for extended periods. Furnace 2 may be run on a continual feed and batch tapping process which requires that the level of lance 4 is continuously controlled to avoid contact with the matte layer or may be run on a batch or continuous basis.

Apparatus 15 to raise and lower lance 4 within furnace 2 is seen in FIGS. 3 to 7. This apparatus includes carriage 7 having a rigid frame of upright members 20 and cross members 21. Upright members 20 have roller housings 22 mounted at top and bottom for clamping of rollers 16 on axles 23 at front and back. Side rollers 24 on axles 25 are mounted on an inner surface of housings 22 so that both rollers 16 and 24 run along vertical guide channels 8.

A lance supporting cradle 17 is resiliently mounted to carriage 7 by way of two channels 40 extending outwardly from both upright members 20. The cradle comprises two vertically disposed side plates 26 a back plate 27 and horizontally extending profiled plates 28. The cradle is mounted to the carriage via three resilient mountings 29.

FIG. 4 depicts a front view of carriage 7 and lance 4, the arrangement of carriage 7 on guide channels 8 is clearly seen. Lance 4 is releasably supported on cradle 17 of carriage 7 by two opposed laterally projecting shafts 18 protruding from sides of lance 4, which rest in respective slotted cradle plates 26. During mounting the lance is guided by profile plates 28. Shafts 18 are strengthened on the upper edge by angle bracket 19. This arrangement allows pivotal movement of lance 4 during mounting. Lance 4 is, in use, clamped to carriage 7 to prevent accidental disengagement from cradle means 17 by means not illustrated. This clamping may be achieved for example by providing tabs on the lance adapted for bolted coupling to the cradle to restrict the range of pivoted movement. It is necessary that lance 4 is allowed a predetermined degree of movement at tip 12 due to the length of lance 4 and the agitation induced within the bath. If lance 4 were to be held rigidly in place this would result in fracture of the lance or damage to the carriage. It is desirable that tip 12 is allowed to move 2.5° to 5° off centre in any direction. Thus a 10 meter lance might move 60 centimeters from vertical at the tip, Any further movement could result in undesirable mixing of the molten metal and slag causing uneven wear on both the refractory bricks and on the lance tip.

Figure 10:
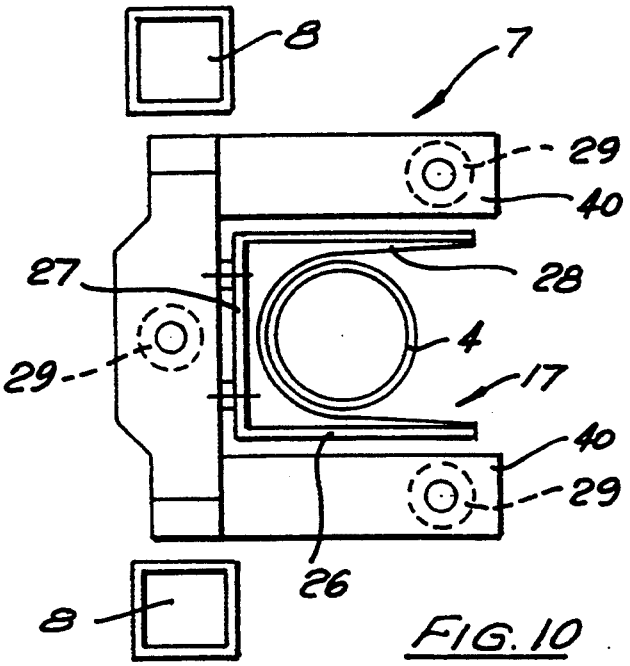
FIG. 10 is a plan view of the internal sleeve of the carriage according to the invention.

As previously described carriage 7 runs on guide channels 8 by way of front and back rollers 16 and side rollers 24, Profile plates 28 are welded within cradle 17 and as seen in FIGS. 5 and 10, Profile plates 28 have an arcuate rear surface of a similar curvature of lance 4 however with a tolerance therebetween. Cradle 17 comprising: profile plates 28 together with slotted cradle side plates 26 is resiliently attached to carriage 7 by a plurality of resilient mounts 29 or compression springs.

A feed pipe 30 at the top of lance 4 projects through the outer wall and connects with inner tube 122 to feed oil through lance 4. Flexible couplings are provided for connection of lance 4 to the air supply and likewise for connection of the oil line 122 to an oil supply.

Figure 7:
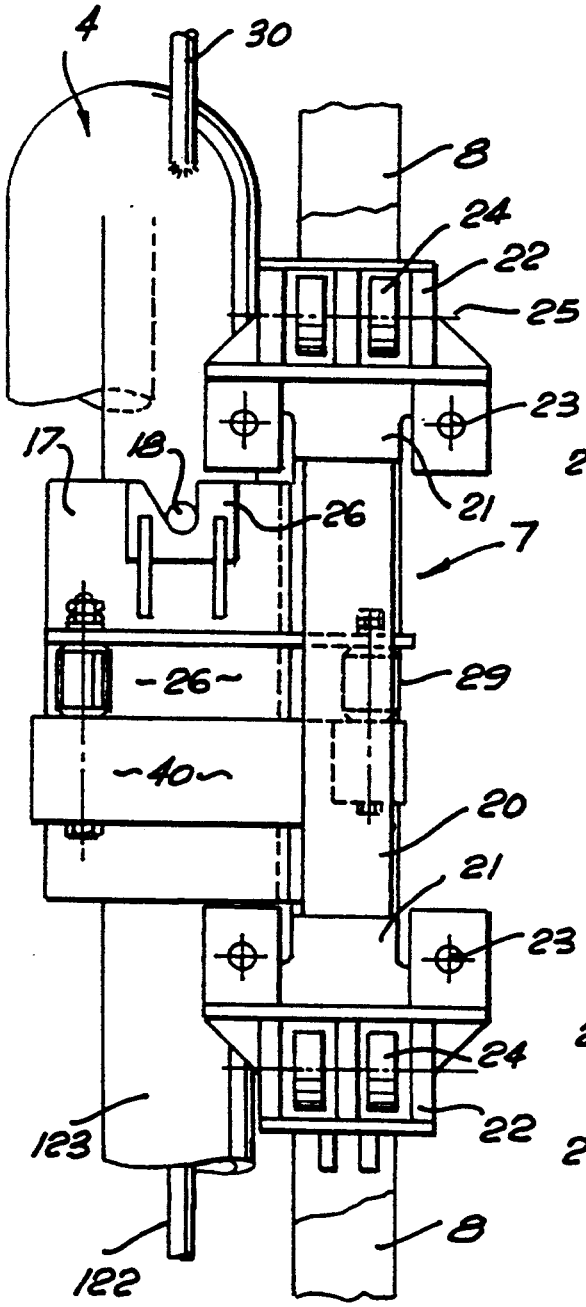
FIG. 7 is a side elevation of the apparatus of FIG. 4.
Figure 6:
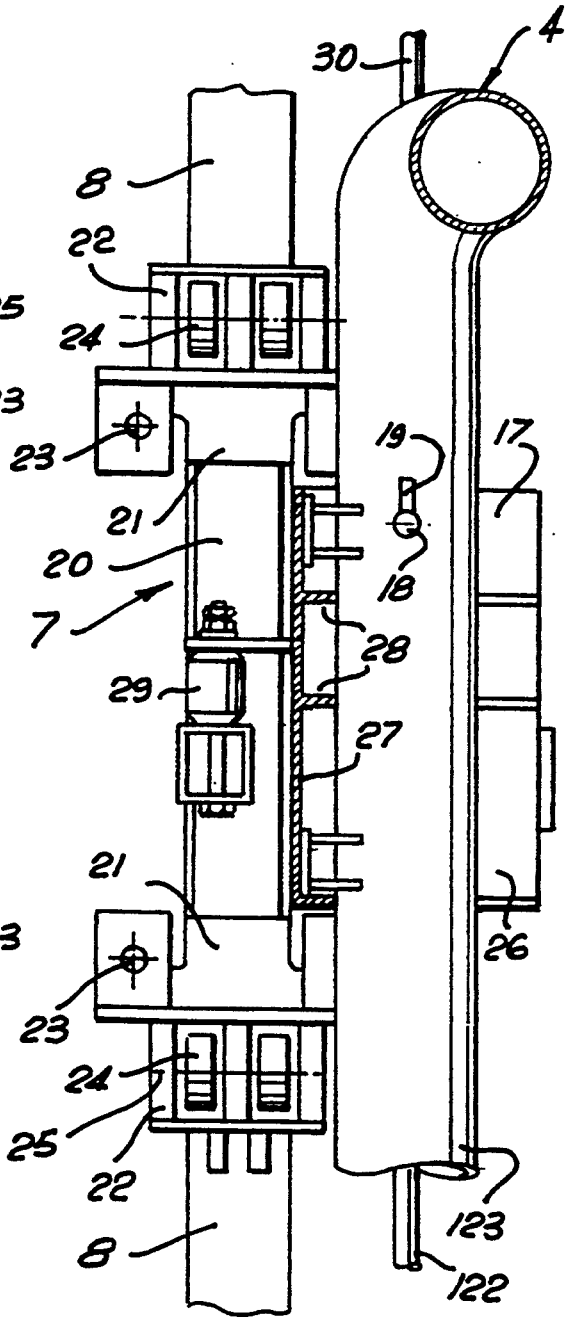
FIG. 6 is a sectional side elevation of the apparatus of FIG. 4.

FIG. 6 is a sectioned side elevation which shows one shaft 18 on the side of lance 4. Side rollers 24 are clearly shown at the top and bottom of carriage 7 for guidance along guide channel 8. The side elevation of FIG. 7 illustrates how shafts 18 fit within the cradle formed by slotted side plate 26. One set of resilient mounts 29 is seen connecting cradle plates 26 to carriage 7 and a further one is shown offset behind column 8.

Figure 8:
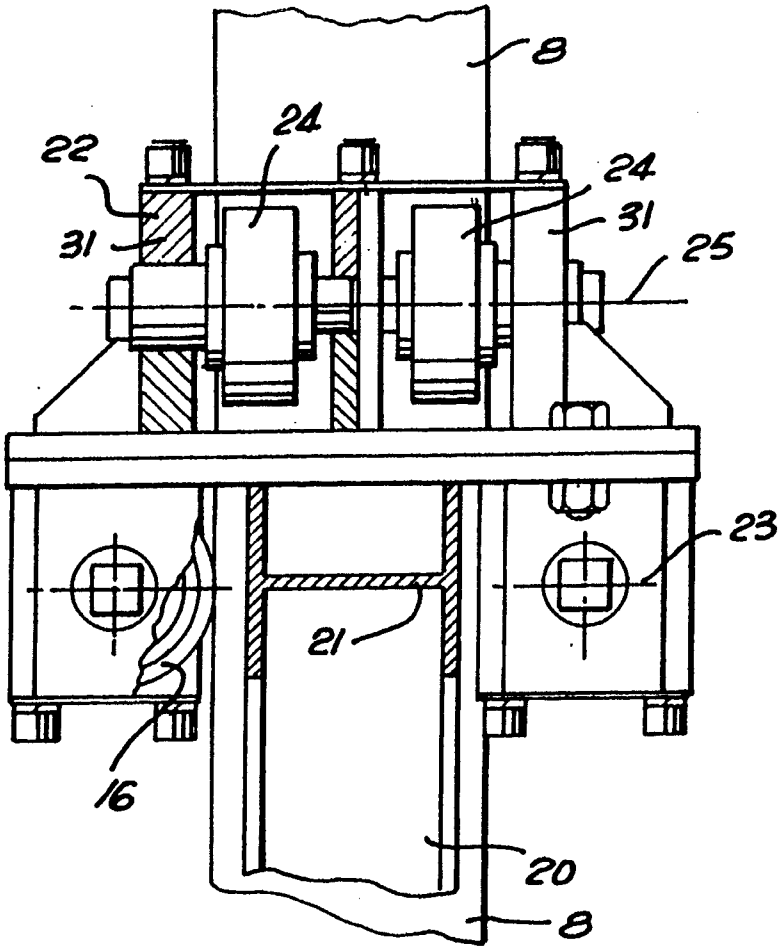
FIG. 8 is a detailed view of the side rollers of the carriage of FIGS. 4 to 7.

A detailed view of roller housing 22 showing a pair of side rollers 24 is depicted in FIG. 8 together with clamping block 31 on either side. Rollers 24 run symmetrically on channel 8 guiding carriage 7 axially up and down the furnace. Housing 22 includes an array of plates and angles bolted together to partially encompass guide channels 8.

Figure 9:
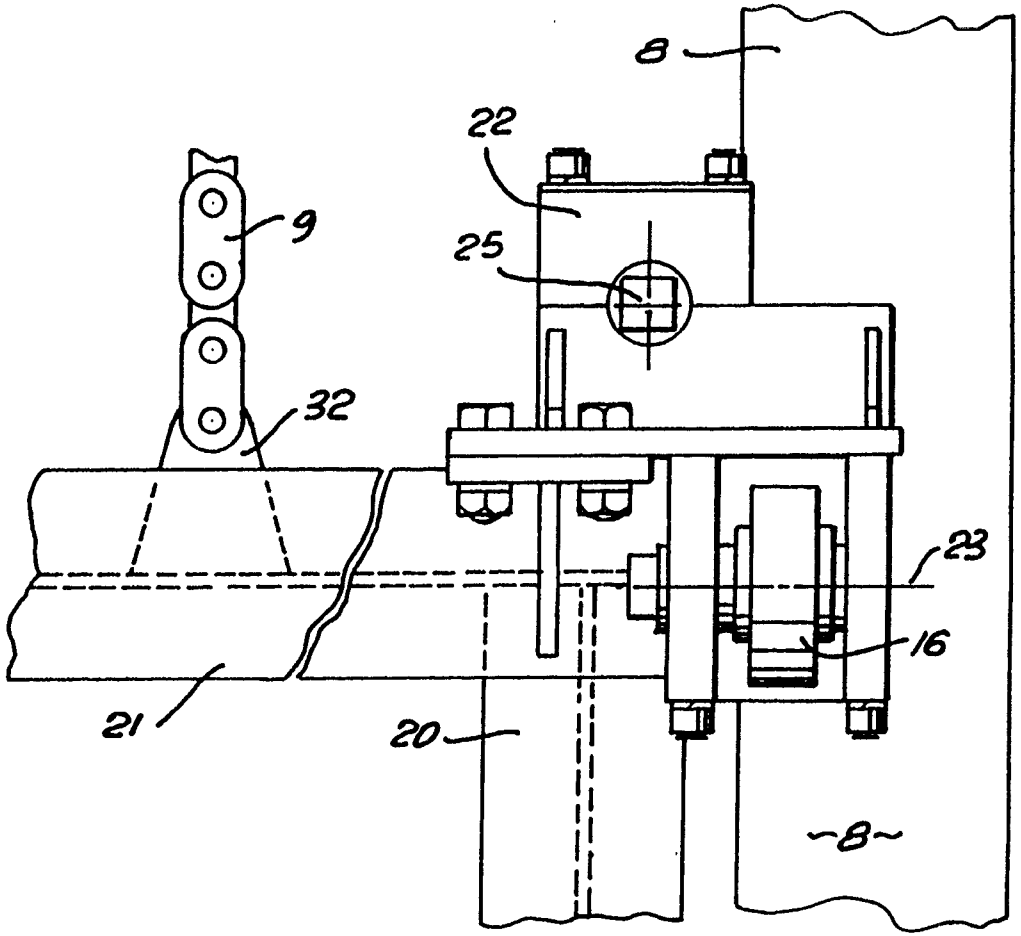
FIG. 9 is a detailed view of the front roller of the carriage and the chain drive.
Figure 11:
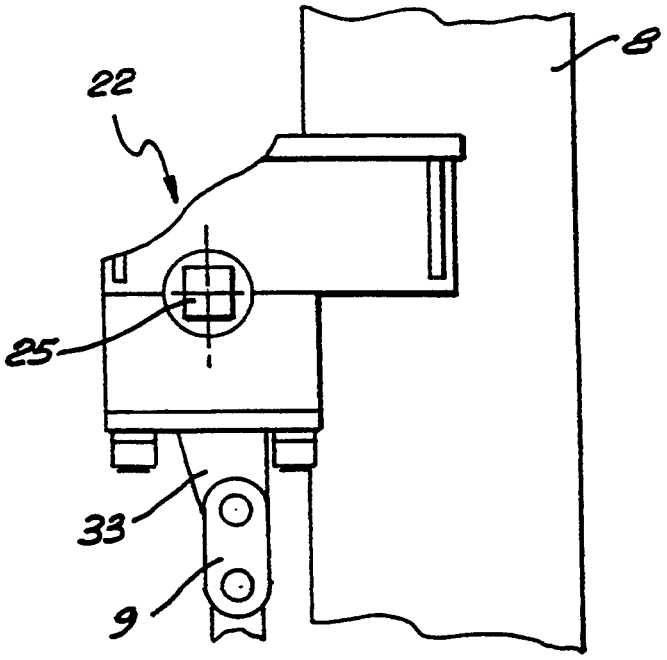
FIG. 11 is a detailed view of the lower chain connection.

Referring to FIG. 1A and 1B it can be seen that lance 4 is moved up and down with carriage 7 by way of a chain 9 and pulley 10 arrangement. FIGS. 9 and 11 show the connection of the chain, firstly to the top of carriage 7 at shackle 32 on cross member 21 and also at one side at the bottom of carriage 7 and on housing 22 at location 33.

In use lance 4 is raised and lowered into furnace 2 when chain 9 is operated over pulleys 10. This controls the movement of carriage 7 along guide columns 8 which restricts movement in directions other than vertical. Lance 4 is also allowed to move through a predetermined angle at tip 12 due to cradle means 17 and the resilient mountings 29 of cradle 17 with respect to on carriage 7. An operator can readily control the depth of immersion of lance 4 within the molten slag to avoid contact with the matte layer.

Whereas air and oil have been disclosed for use with of the lance, other substances for example coal may be injected via suitably designed lances. It is also envisaged that other drive means may be employed to raise and lower the lance, for example, a rack and pinion, or cable or the like.

It is highly preferred that the lance be coupled to supply ducting via a high temperature bellows 14 for example of cloth and a rubber which accommodates the motion of the lance. Duct 5 is provided with swivel joints to accommodate gross lance movement.

The lance may be coupled to supply systems by other flexible means and/or the ducting may be provided with valves and disconnected when the lance is raised.

Although the invention has been described with reference to specific examples, it will be appreciated by those skilled in the art that the invention may be embodied in other forms without departing from the scope hereof.

I claim:

1. Apparatus for injecting material below the surface of a furnace bath comprising an elongate lance having a lance lower end with a lateral projection, a carriage including lance mounting means resiliently connected to the carriage to permit restricting lateral movement of the lance lower end relative to the furnace bath wherein said lance mounting means comprises a cradle for receiving said lateral projection, means for guiding the carriage upwardly and downwardly whereby to move the lance lower end between a position above the bath and a position submerged in the bath, and means to permit restricted lateral movement of the lance lower end relative to the furnace bath.

2. Apparatus according to claim 1 wherein the means for guiding the carriage upwardly and downwardly comprises at least one guide column extending above the furnace.

3. Apparatus according to claim 1 wherein the lance mounting means is resiliently connected to the carriage by means including a plurality of compression springs.

4. Apparatus according to claim 1 wherein the lance lower end is free to move through an angle of up to but not more than 5.0° from vertical.

5. Apparatus according to claim 1 wherein the lance lower end is free to move through an angle of up to but not more than 2.5° from vertical.

6. A method of injecting material below an upper surface of a bath in a furnace comprising the steps of:

releasably supporting an elongate lance on a carriage, guiding the carriage upwardly or downwardly so as to move the lance between a raised position in which a lower lance end is above the bath, and a lower position in which the lower lance end is submerged in the bath, and permitting the lower lance end to move laterally with a restricted latitude of movement.

7. A method according to claim 6 wherein the latitude of movement of the lance lower end is selected to be sufficiently great to resist fracture of the lance.

8. A method according to claim 6 wherein the latitude of movement of the lance lower end is limited so as to minimize undesirable disturbance of the bath.

9. A method according to claim 7 wherein the lower end of the lance is free to move through an angle of up to 5.0° from vertical.

10. A method according to claim 7 wherein the lower end of the lance is free to move through an angle of up to 2.5° from vertical.

* * * * *